United States Patent [19]

Luhowyj

[11] Patent Number: 4,709,460

[45] Date of Patent: Dec. 1, 1987

[54] PANEL INSTALLATION TOOL AND METHOD

[76] Inventor: Vladimir Luhowyj, 2209 W. Erie, Chicago, Ill. 60612

[21] Appl. No.: 939,273

[22] Filed: Dec. 10, 1986

Related U.S. Application Data

[63] Continuation of Ser. No. 742,904, Jun. 10, 1985, abandoned.

[51] Int. Cl.[4] ..... B25B 11/00

[52] U.S. Cl. ..... 29/271; 248/544; 269/46

[58] Field of Search ..... 269/46, 904; 52/DIG. 1; 248/544, 200, 300; 312/198; 29/468, 271

[56] References Cited

U.S. PATENT DOCUMENTS

| | | | |
|---|---|---|---|
| 479,331 | 7/1892 | McGregor | 248/200 |
| 1,592,974 | 7/1926 | Foerster, Sr. et al. | 248/300 X |
| 2,350,433 | 6/1944 | Vernon | 248/300 X |
| 2,918,242 | 12/1959 | Olivette et al. | 248/544 |
| 3,239,172 | 3/1966 | Chalmers | 248/300 X |
| 4,264,063 | 4/1981 | Halula | 269/904 X |
| 4,467,486 | 8/1984 | Schatz | 248/300 X |
| 4,490,198 | 12/1984 | Mitchell | 269/904 X |
| 4,564,182 | 1/1986 | Svajgl | 269/904 X |

FOREIGN PATENT DOCUMENTS

| | | | |
|---|---|---|---|
| 1214797 | 12/1970 | United Kingdom | 248/544 |

*Primary Examiner*—Howard N. Goldberg
*Assistant Examiner*—Joseph M. Gorski
*Attorney, Agent, or Firm*—John H. Shurtleff

[57] ABSTRACT

A combination support and guide tool and a method for the installation of rectangular, flat ceiling panels or the like by a single person onto regularly spaced, parallel structural members of a building such as ceiling joists, the tool comprising an elongated rigid support plate and a guide plate which is connected at the leading edge of the support plate and forms a critical acute angle of panel insertion adapted to easily and safely slide the panel into place. The method comprises the use of such a support and guide tool to positively receive and guide both initial panels and subsequent panels into their required positions on the ceiling joists or similar structural members.

10 Claims, 7 Drawing Figures

PANEL INSTALLATION TOOL AND METHOD

This application is a continuation of application Ser. No. 742,904 filed June 10, 1985 now abandoned.

BACKGROUND OF THE INVENTION

This invention is concerned with the installation of ceiling panels or similar boards, sheets or the like in residential and commercial construction, especially where there are large surface areas to be covered with gypsum board or so-called "sheetrock" panels of a large, flat and rectangular shape, usually in 4×8-foot units with a thickness of about ¼-inch to ⅝-inch, although sizes smaller and larger than 4×8-foot sections are also common. These large boards or panels are fastened by means of nails or screws to the ceiling joists which normally run perpendicular to the longest dimension of a room and parallel to each other on 12-inch or 16-inch centers. Detailed specifications for the materials and methods of installing such ceilings are readily available in standard books or suppliers' brochures, attention being directed for example to "Carpentry and Building Construction" by John L. Feirer and Gilbert R. Hutchings, publ. by Chas. A. Bennett Co., Peoria, Ill., 1976, pages 734–752, this subject matter being incorporated herein by reference as fully as if set forth in its entirety.

A long existing problem in the installation of such ceilings has been the need to use at least two people on the job in order to raise and hold each board or panel in place while it is initially applied to the ceiling joists and fastened in place. Only one prior reference has been found which attempts to address this problem, namely U.S. Pat. No. 3,953,015, issued Apr. 17, 1976, to John D. Taylor and Tommy R. Whitmer. Aside from this reference, the practice has always been followed in this art of using two persons to mount each ceiling panel and even three persons for larger 4×12-foot panels. For a more recent discussion of this problem, attention is directed to "INTERIOR FINISH: More Tricks of the Trade", by Bob Syvanen, an East Woods Press Book, Fast And McMillan Publishers, Inc., Charlotte N.C., 1982, pp. 22–23. While warning that a ceiling installation needs two people, the author also recommends the use of two "T" braces to temporarily wedge the sheetrock panel in place. But he also cautions that such braces must be exactly the right length between floor and ceiling to avoid serious problems. These "T" braces are also commonly used by one person to hold up one end of the panel while a second person nails or screws the other end of the panel in place. It is very difficult if not impossible for a single person to work with such braces or similar "makeshift" devices, and even with two people, it is quite difficult to work together and to accurately align and quickly install each ceiling panel across an entire room. Moreover, these known tools or devices offer no help in mounting the first panel in place, i.e. in the corner or along one side of a room.

The panel needs to be held firmly against the ceiling while the first nails or screws are fastened in place because movement of the panel during or after this initial fastening will cause the fasteners to loosen or to enlarge or distort the holes which they make in the panel. Errors in alignment of subsequent panels are then difficult to avoid, and extra nails or screws as well as repair work are necessary to correct a poorly fitted panel. In the past, these problems have been avoided only with the use of two people on the job.

It is thus a primary object of the present invention to provide a tool which will permit a single person to carry out a method of installing ceiling panels or the like in a rapid and accurate manner. Other objects and advantages of the invention will become more apparent upon consideration of the following detailed specification together with the accompanying drawings and claims.

SUMMARY OF THE INVENTION

It has now been found in accordance with the invention that a single person can install rectangular, flat ceiling panels or the like onto regularly spaced, parallel structural members of a building such as ceiling joists or the like by using a novel combination support and guide tool which comprises:

(a) an elongated rigid support plate adapted to transversely span a plurality of said parallel structural members with the leading edge of said plate perpendicular to the parallel direction of said structural members, said support plate containing a plurality of slot openings in its trailing edge for alignment with at least two of said parallel structural members, said openings extending forwardly toward the leading edge to receive a fastening element through the opening into the associated structural member with the edges of the opening engaging a retaining head of the fastening element; and (b) an elongated rigid guide plate connected to the leading edge of said support plate such that the guide plate forms an acute angle of substantially less than 45° with the panel to be mounted on said parallel structural members, thereby positively and safely guiding the panel along the surface of said guide plate and into the narrow gap or channel formed between the leading edge of the support plate and the plurality of parallel support members. The terms "leading" and "trailing" are used here with reference to the direction in which installation proceeds, i.e. toward the panel or panels being mounted and away from the initial side walls or edges of the structural surfaces being covered by such panels.

It has further been found that, with the aid of the tool according to the invention, an improved method for mounting ceiling panels or the like is achieved by the steps which comprise temporarily fastening a straight, elongated, rigid guide member in a position corresponding to only a portion of the length of one edge of the panel along at least one of a plurality of regularly spaced, parallel structural members such that one straight edge of the guide member defines a gap space with reference to the surface being covered about equal to the thickness of the panel to be mounted, sliding a panel into this gap space to be temporarily held there by the guide member over said portion of the panel length, and then permanently fastening the panel to the parallel structural members in areas not occupied by the guide member, and subsequently unfastening said guide member and using it again to mount another panel.

THE DRAWINGS

The invention is illustrated by way of example in the accompanying drawings in which.

Figure 1:
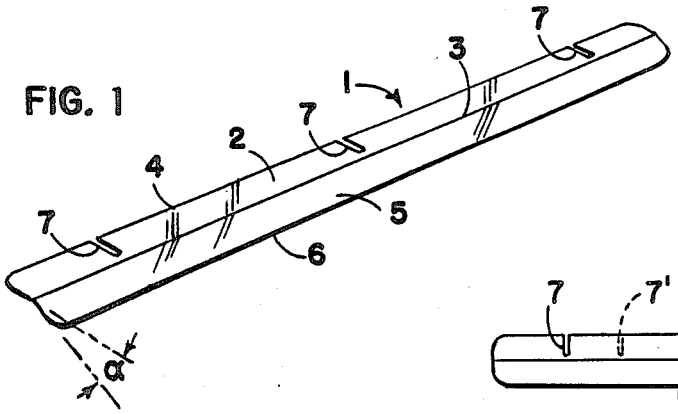
FIG. 1 is a perspective view as seen from above the combination support and guide tool of the invention in its most preferred form but reduced from actual size.
Figure 2:
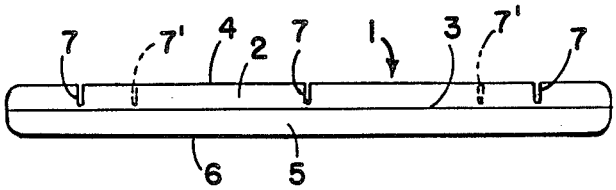
FIG. 2 is a top plan view of the same tool shown in FIG. 1.
Figure 3:
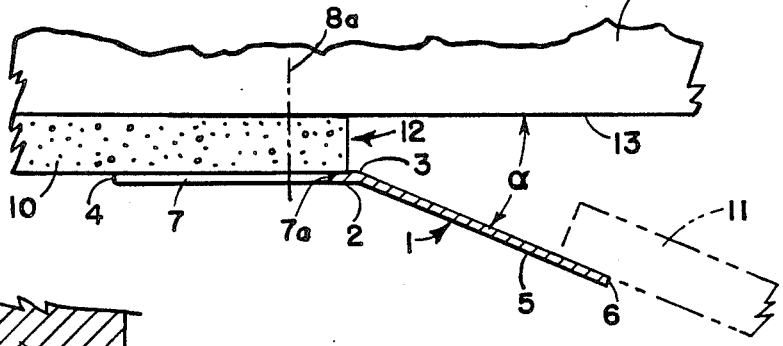
Figure 4:
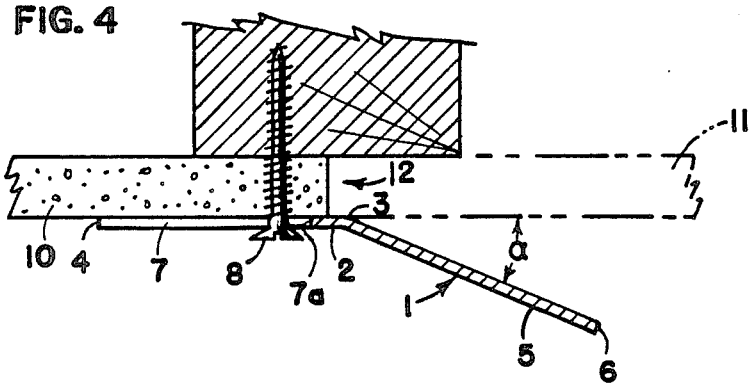
Figure 5:
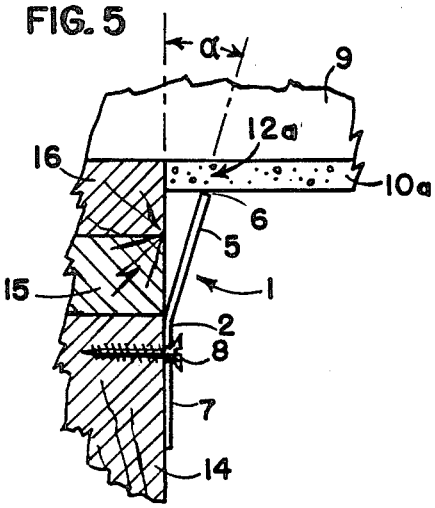
Figure 6:
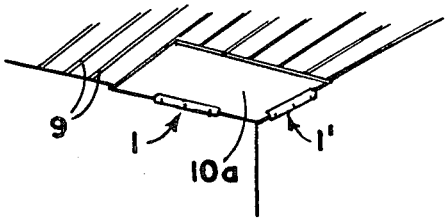
Figure 7:
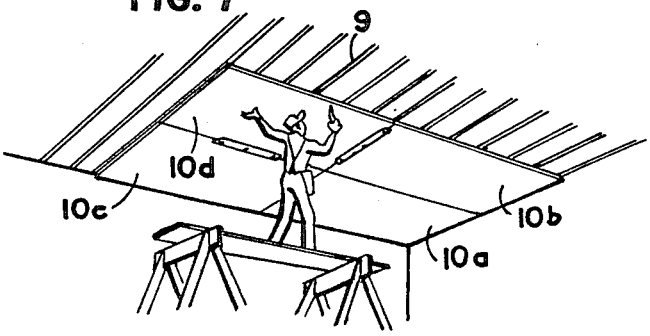

FIG. 3 is a full size cross sectional view of the tool taken on a plane perpendicular to the leading edges 3 and 6 of the tool of FIGS. 1 and 2, passing through the middle of the center slot 7, and includes a supported ceiling panel and a side elevational view of one ceiling joist running perpendicluar to said leading edges of the tool and also includes a partial phantom view of a second panel being guided by the angled forward flange or guide plate 5 of the tool;

FIG. 4 is a full size cross sectional view of the tool substantially as in FIG. 3 but with the leading edge 3 of the tool parallel with and at about the midpoint of the ceiling joist 9, shown here from one end in a cross sectional view, the supported panel being held in place by a mounting screw 8 while the second panel, shown in partial phantom view, is positioned horizontally against the ceiling joist for screw fastening thereto;

FIG. 5 is a side elevational view, partly in cross section and reduced from full size to illustrate the initial mounting of a ceiling panel at one side or corner of a room, the tool being mounted by its rear flange or support plate 2 while positioning and temporarily holding a ceiling panel on the top or front edge of the forward flange or guide plate 5;

FIG. 6 is a perspective view from below the ceiling, greatly reduced in size, to illustrate the inital installation of a first ceiling panel in the corner of a room; and FIG. 7 is a perspective view from below similar to FIG. 6, but illustrating the use of two tools in the installation of a central ceiling panel following the initial installation of a corner panel and two additional panels along two adjacent side walls of the room.

DETAILED DESCRIPTION OF THE INVENTION

Referring first to FIGS. 1 and 2, the guide and support tool 1 of the invention is generally shown as a preferred embodiment measuring about 36 inches in length and with rounded corners to avoid sharp points at either end which might cause personal injuries or property damage in actual use. The preferred length is about 33 to 45 inches, especially about 35 to 42 inches. As illustrated, this preferred embodiment is made of a single piece, i.e. an integral shaped unit composed of stainless steel with a thickness of about 1/16 inch. The tool 1 essentially includes a supporting flange member or support plate 2 with a leading edge 3 and a trailing edge 4 which are parallel to each other, and a guide plate 5 substantially coextensive with and arranged at an acute angle $\alpha$ of about 20° to the horizontal support plate 2 as shown in FIG. 1. This angle $\alpha$ is critical in providing the desired panel guiding function of the tool 1, as discussed in greater detail below. The front or leading edge 6 of the guide plate 5 is also preferably parallel to the leading edge 3 and trailing edge 4 of the support plate 2.

It is most convenient to stamp out or cut the entire tool from a metal sheet to provide a generally elongated rectangular shape, and then crimp or bend it along the leading edge 3 to provide suitable dimensions for each of the flanges or plates 2 and 5. As shown in full size in FIGS. 3 and 4, the support plate 2 has a width of about $1\frac{5}{8}$ inches while the guide plate 5 has a width of about $1\frac{3}{4}$ inches. In general, these two plates are preferably about equal in width although in principle the guide plate 5 could be even wider except for the added weight and expense. The support plate 2 ought to have a width of at least 1 inch and is preferably not more than $2\frac{1}{2}$ inches. The guide plate is preferably maintained within these same limits but could be as small as $\frac{1}{2}$ inch and still perform a reasonable guiding function. Because the support plate 2 is most often mounted onto the 2-inch surface of a supporting joist or stud, its width is preferably about $1\frac{1}{4}$ inches to 2 inches.

In order to mount the support plate 2 onto one or more joists, studs or similar structures, a plurality of slot openings 7 are formed in the trailing edge 4 on 16-inch centers, i.e. at 16-inch intervals, corresponding to the most common spacing of the joists or studs. These slots 7 must not extend all the way to the leading edge 3 of support plate 2 but should terminate at a point 7*a* about $\frac{1}{8}$ to $\frac{3}{8}$ inch, preferably about $\frac{1}{4}$ inch away from this leading edge 3. When the tool 1 is arranged transversely to the parallel joists or studs, the openings 7 will be aligned with these wood supporting structures so that a nail or preferably a screw 8 can be used as a fastening element near the inner end 7*a* of the slot to temporarily secure this combination support and guide tool in place (see especially FIG. 4). The head of the screw 8 is flanged or otherwise enlarged sufficiently to engage the side edges of slot 7 in a detachable or reversible manner. Additional slot openings 7′ can also be provided on 12-inch centers as indicated in phantom lines on FIG. 2 so that the tool may also be used for this less common spacing of joists or studs.

It will be understood that the tool 1 can be made of any number of different materials provided that they offer stiff or rigid support for the support and guide flanges, but stainless steel is clearly advantageous in terms of durability, resistance to corrosion and ease of cleaning. The two flanges or plates 2 and 5 could be produced separately or even in several pieces and then connected together on a common centerpiece, so as to provide both support and guide functions without departing from the spirit or scope of the invention. The illustrated preferred embodiment is advantageous in providing an easily shaped and constructed one-piece tool which requires no additional members such as a handle or gripping member, additional openings to reduce weight, curved lip portions, add-on flanges or other extra parts, all of which are deemed to be optional and less desirable for purposes of the invention. The new tool is designed as a utility item which is economical to produce and quite efficient and easy to use by a single person.

In FIGS. 3 and 4, the installation of ceiling panels is illustrated as it would occur along one or preferably both of two adjacent edges of the panel to be installed. FIGS. 5 and 6 show how the tool of the invention can be used for initially positioning and supporting those panels initially located along a wall or in the corner of a room. FIG. 7 illustrates installation by one person of a ceiling panel in the middle of the room, using two of the tools according to the invention in order to guide and support two adjacent panel edges at the same time. It will be understood that the tool of the invention may also be used to mount vertical wall panels in an analogous manner even though its primary utility is for horizontal or angled ceiling panels.

In FIG. 3, the ceiling joist 9 runs perpendicular or transversely to the longitudinal direction of the tool 1 with a first partially mounted or fully installed ceiling panel 10 being held by nails or preferably screws at positions corresponding to the centerline 8*a* or the actual screw fastener 8 of FIG. 4. The slots 7 on 16-inch centers permit three temporary screw fastening positions through the tool directly into three adjacent and parallel ceiling joists 9. After the first ceiling panel 10 is mounted in place, a second ceiling panel 11 (phantom lines) is guided up the inclined plane of the forward flange or guide plate 5 directly into the narrow gap or channel 12 formed between the leading edge 3 of support plate 2 and the underneath surface 13 of the ceiling joist 9. This gap 12 can be positioned very closely to the leading edge 3 or it can be set back a short distance to form a narrow receiving channel for the edge of the second panel 11 as it is moved into its permanent horizontal position (see FIG. 4). In general, the depth of this slot or channel 12 is preferably not more than $\frac{1}{4}$ to $\frac{3}{8}$ inch but can be quite short, e.g. to provide a lip of as little as about 1/32 inch.

In FIG. 4, the fastening screw 8 holds the panel 10 firmly or snugly in place so that the gap 12 between leading edge 3 and joist 9 is just sufficient to position the second panel 11 in place up against the leading edge of the first panel 10. In this position, a single person can hold the panel in position with one hand while securing a number of screws, preferably with the aid of a motor driven hand tool, so as to firmly hold this second panel in place.

In general, the tool 1 is not removed until a few screws have been used on all sides of the added panel 11. The three screws 8, which also attach the tool 1 through each of the three slots 7, are then backed off just enough to slip the tool forwardly and away from its temporary mounting, so that it can be used again to install the next panel. The three screws 8 are then driven completely in place. As commonly practiced, all fastening means such as screws or nails are driven partly into the surface of the sheetrock panel, i.e. so as to be slightly countersunk or hammered as a "dimple" into the panel surface, thereafter covering the head of the screw or nail with a suitable filler such as a joint cement or the like.

FIGS. 5 and 6 show that the tool of the invention can be readily used to insert the first ceiling panel **10*a* in the corner of the room, preferably using two identical tools 1 and 1' for this panel In this case, the tool 1 or 1' is placed transversely across a number of studs 14 and/or along any associated set of wood plates 15 and 16 as commonly used in the sidewalls of a room to support the ceiling joists 9. Again, it is preferable to use screws 8 through the slots 7 in support plate 2 of the tool 1 or 1' to temporarily mount the tool in place such that the top or leading edge 6 of the guide plate 5 provides a gap space 12*a* just sufficient to receive the panel 10*a*. Here the angle $\alpha$ is measured from the vertical supporting surface of the room. With the preferred dimensions of the tool, the corner panel 10*a* is very securely supported by the guide plate 5, especially when using both tools 1 and 1' as shown in FIG. 6. Once permanent screws are driven into the corner panel, or into any ceiling panel along the side of a room, the temporary screws 8 can be completely removed from the vertical studs 14 to withdraw and reuse the individual tools for installing additional panels, e.g. panels 10*b* and 10*c* which abut the corner panel 10*a*** and extend along the side walls of the room.

FIG. 7 indicates the installation of the first center panel **10*d* away from the corner or side walls of the room while also illustrating the manner in which a single person can guide this center panel into place along the guide surfaces of one or preferably two tools 1 and 1' according to the invention. Thus, even with a high ceiling, one person can stand on a platform or plank between a set of sawhorses in order to position the center panel 10*d* in the previously mounted tools 1 and 1' and then drive screws along the edges of panel 10*d* into the associated ceiling joists 9**.

The acute angle $\alpha$ must be much smaller than 45° if a single person is to easily manipulate and guide a ceiling panel or the like along the guide plate 5 into the desired position for installation without undue friction and possible damage to the panel. In practice, depending on the size and weight of the individual panel, it has been found that this angle $\alpha$ should fall within limits of about 5° to 35°, preferably about 10° up to about 30°. Using the most conventional 4×8 sheetrock panels, the ideal angle $\alpha$ has proven to be about 17° to 22°. As the angle becomes smaller, greater strength and accuracy is required to lift the panel up and begin its slipping or sliding movement along the guide plate 5. On the other hand as the angle becomes greater, there is a greater tendency to push the end of the panel into the guide plate surface rather to have it ride smoothly along its lower planar surface. Moreover, the transition from the guide angle into the gap or channel 12 is much greater, and it becomes more difficult to achieve a final upward and inward movement of the guided panel into this gap or channel.

By providing a guide plate 5 which is substantially coextensive with the elongated support plate 2, danger of damage to the panel during its installation is greatly reduced, especially within the preferred or ideal limits of the angle $\alpha$. Also, rounded corners at either end of the coextensive plates is advisable to reduce panel damage as well as to provide a safer tool in terms of potential personal injury or property damage.

It is quite helpful for a single person to use a supported walkway or scaffolding arrangement as in FIG. 7 so as to stand as close to the ceiling as possible while still being erect. With at least one support and guide tool mounted in place, the ceiling panel can be lifted and guided with both hands along the guide plate 5 and into the gap or channel 12. Once positioned and supported on the lip of the support plate 2 immediately adjacent its forward or leading edge 3, the panel **10*d* being installed can be held with one hand as indicated while operating a motor driven screwdriver with the other hand, e.g. to first fasten those edges of the panel opposite the tool 1 or 1' of the invention. Then additional screws can be fastened in those free portions or edge areas which extend from either end of each tool 1 or 1'** along the supported edges of the ceiling panel. Actually, only a few screws in the edges opposite or away from the tools are needed to hold the panel securely in place and permit use of both hands by the installer. A handheld screwdriver equipped with an automatic feed of individual screws is most advantageous in achieving a rapid screw fastening operation.

Once an individual panel is firmly fastened to the ceiling, it is a simple manner to slightly unscrew the three screws holding each tool 1 and 1' and slide the tools forward to disengage the screws from the slots 7. The slightly loosened screws which held the individual support and guide tool can then be driven home to complete the installation in the edge occupied by the tool. In general the tools 1 and 1' should occupy not more than about $\frac{3}{4}$ to $\frac{7}{8}$ along a central portion of the supported edge of the ceiling panel.

A single person, using the tool of the invention, can reduce the time needed to install a ceiling by 10 to 15%, even as compared to a two person operation. It will be apparent, of course, that two or more persons can work together on a large installation, each cooperating in the use of the individual support and guide tools and with very little interference with each other. Such cooperation enhances the ease of installation of ceiling panels with the aid of the new tools. The tool of the invention is also intended for use by a relatively unskilled person seeking to do his own work alone or with minimal help from another unskilled worker. Again, the installation proceeds more quickly and with much greater accuracy than would be possible without a tool constructed and arranged in accordance with the invention.

The invention is hereby claimed as follows:

1. A combination support and guide tool for installing rectangular, flat ceiling or wall panels by a single person onto regularly spaced, parallel structural members of a building such as ceiling joists or wall studs, said tool comprising:

support and guide plate means for supporting one of said panels as the one panel is installed against said parallel structural members, said means comprising (a) an elongated rigid support plate with a length defined by a longitudinally extending front leading edge and back trailing edge, and a width much smaller than its length defined by two side edges, said length being sufficient to transversely span a plurality of said parallel structural members, said support plate containing a plurality of slot openings which start at its trailing edge and which are spaced along its length for alignment with at least two of said parllel structural members, said slot openings having side edges extending forwardly from said trailing edge toward the leading edge in order to receive a fastening element, and further comprising (b) an elongated rigid guide plate connected to the leading edge of said support plate such that the guide plate forms an acute angle of substantially less than 45° with reference to a planar extension of the support plate beyond its leading edge.

2. A tool as claimed in claim 1 wherein said acute angle is about 5° to 35°.

3. A tool as claimed in claim 1 wherein said acute angle is about 10° to 30°.

4. A tool as claimed in claim 1 wherein said acute angle is about 17° to 22°.

5. A tool as claimed in claim 1 which is an integral structure made of stainless steel.

6. A tool as claimed in claim 1 wherein the guide plate is substantially coextensive with the elongated support plate.

7. A tool as claimed in claim 6 wherein the tool has an overall length of about 33 to 45 inches, a width of the support plate of about 1 to 2½ inches and a width of the guide plate of about ½ inch to 2½ inches, said acute angle being in the range of about 17° to 22°.

8. A tool as claimed in claim 1 wherein said slot openings extend up to about ⅛ inch to ⅜ inch from the leading edge of the support plate.

9. A tool as claimed in claim 1 containing at least three of said slot openings at uniformly spaced intervals.

10. A tool as claimed in claim 9 containing five slot openings consisting of one center slot opening, two slot openings on 16-inch centers as measured from either side of said center slot opening, and an additional two slot openings on 12 inch centers as measured from either side of said center slot opening.

* * * * *